US005676119A

United States Patent [19]

Tsutsumi et al.

[11] Patent Number: 5,676,119

[45] Date of Patent: Oct. 14, 1997

[54] AIR-FUEL RATIO CONTROL SYSTEM FOR INTERNAL COMBUSTION ENGINES

[75] Inventors: Kojiro Tsutsumi; Shuichi Hosoi; Shigeto Kashiwabara; Katsuhiko Suzuki; Sachito Fujimoto, all of Wako, Japan

[73] Assignee: Honda Giken Kogyo Kabushiki Kaisha, Tokyo, Japan

[21] Appl. No.: 719,565

[22] Filed: Sep. 25, 1996

[30] Foreign Application Priority Data

Sep. 25, 1995 [JP] Japan ..... 7-268987

[51] Int. Cl.[6] ..... F02D 41/00

[52] U.S. Cl. ..... 123/688

[58] Field of Search ..... 123/688, 682, 123/696, 703, 680; 204/425; 60/274, 276; 364/431.05

[56] References Cited

U.S. PATENT DOCUMENTS

| | | | |
|---|---|---|---|
| 5,340,462 | 8/1994 | Suzuki | 123/688 |
| 5,396,765 | 3/1995 | Maruyama et al. | 60/276 |
| 5,433,185 | 7/1995 | Toyoda | 123/688 |
| 5,485,382 | 1/1996 | Seki et al. | 364/431.05 |
| 5,505,183 | 4/1996 | Sinha et al. | 123/688 |
| 5,526,798 | 6/1996 | Seki | 123/688 |
| 5,533,332 | 7/1996 | Uchikawa | 60/274 |
| 5,575,266 | 11/1996 | Iida | 123/680 |

FOREIGN PATENT DOCUMENTS

| | | | |
|---|---|---|---|
| 7-259614 | 10/1995 | Japan | 123/688 |

*Primary Examiner*—Raymond A. Nelli

*Attorney, Agent, or Firm*—Nikaido, Marmelstein, Murray & Oram LLP

[57] ABSTRACT

An air-fuel ratio control system for an internal combustion engine has an exhaust gas component concentration sensor having a sensor element and arranged in the exhaust system of the engine, for detecting concentration of a predetermined component present in exhaust gases emitted from the engine. An ECU controls the air-fuel ratio of an air-fuel mixture supplied to the engine, based on results of comparison between an output value from the sensor and a predetermined reference value, and detects deterioration of the exhaust gas component concentration sensor, based on the output value from the sensor. Engine operating condition sensors detect operating conditions of the engine. It is determined whether or not the engine is in a predetermined engine operating condition in which the sensor element temperature of the exhaust gas component concentration sensor lowers, based on outputs from the engine operating condition sensors. Detection of deterioration of the sensor is inhibited over a predetermined time period after the engine leaves the predetermined operating condition.

10 Claims, 6 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which has a function of detecting deterioration of an exhaust gas component concentration sensor arranged in the exhaust system of the engine.

2. Prior Art

An air-fuel ratio control system for an internal combustion engine is generally provided with an exhaust gas component concentration sensor arranged in the exhaust system of the engine, and functions to reduce amounts of noxious components in exhaust gases emitted from the engine by controlling the air-fuel ratio of an air-fuel mixture supplied to the engine in a feedback manner responsive to an output from the exhaust gas component concentration sensor. In the air-fuel ratio control system, however, if the exhaust gas component concentration sensor is deteriorated, the air-fuel ratio feedback control cannot be carried out in a desired manner, resulting in erroneous calculation of the fuel injection amount supplied to the engine, to thereby degrade exhaust emission characteristics and drivability of the engine. Therefore, monitoring is carried out to detect deterioration of the exhausts gas component concentration sensor, and when the deterioration of the exhaust gas component concentration sensor is detected, the air-fuel ratio feedback control is immediately terminated.

Further, if detection of the deterioration of the exhaust gas component concentration sensor is carried out when the operating condition of the engine determined by parameters representative of engine rotational speed, load on the engine, engine coolant temperature, intake air temperature, etc. is not stable, there is a possibility that the sensor is erroneously determined to be deteriorated. Therefore, to avoid the erroneous determination of the sensor deterioration, an air-fuel ratio control system has been proposed, for example, by Japanese Laid-Open Patent Publication (Kokai) No. 7-259614 (corresponding to U.S. Ser. No. 08/405,519), which monitors the sensor deterioration only when the operating condition of the engine is stable. It is determined that the exhaust gas component concentration is deteriorated when an output from the sensor has an inversion period thereof longer than a predetermined value.

According to the proposed air-fuel ratio control system, however, the monitoring for the deterioration of the exhaust gas component concentration sensor is carried out only when the operating condition of the engine is stable, which can unfavorably lead to an erroneous determination of the sensor deterioration. More specifically, for example, when a fuel cut state is continued by applying engine brake for a long time period so that the sensor element temperature of the exhaust gas component concentration sensor lowers, and then if monitoring conditions for the deterioration of the exhaust gas component concentration sensor become satisfied so that the monitoring is carried out, the inversion period of an output from the sensor is prolonged due to the lowering of the sensor element temperature of the exhaust gas component concentration sensor, resulting in an erroneous determination of the sensor deterioration though the sensor is not actually deteriorated.

SUMMARY OF THE INVENTION

It is the object of the invention to provide an air-fuel ratio control system for internal combustion engines, which is capable of preventing an erroneous determination as to the deterioration of the exhaust gas component concentration sensor even if the engine has been under fuel cut over a long time period.

To attain the above object, according to a first aspect of the present invention, there is provided an air-fuel ratio control system for an internal combustion engine having an exhaust system, comprising:

- an exhaust gas component concentration sensor having a sensor element and arranged in the exhaust system, for detecting concentration of a predetermined component present in exhaust gases emitted from the engine;
- air-fuel ratio control means for controlling an air-fuel ratio of an air-fuel mixture supplied to the engine, based on results of comparison between an output value from the exhaust gas component concentration sensor and a predetermined reference value;
- deterioration-detecting means for detecting deterioration of the exhaust gas component concentration sensor, based on the output value from the exhaust gas component concentration sensor;
- engine operating condition-detecting means for detecting operating conditions of the engine;
- engine operating condition-determining means for determining whether or not the engine is in a predetermined operating condition in which a temperature of the sensor element of the exhaust gas component concentration sensor lowers, based on results of detection by the engine operating condition-detecting means; and
- deterioration detection-inhibiting means for inhibiting detection of deterioration of the exhaust gas component concentration sensor by the deterioration-detecting means over a predetermined time period after the engine leaves the predetermined operating condition.

Preferably, the deterioration-detecting means detects deterioration of the exhaust gas component concentration sensor, based on an inversion period of the output value from the exhaust gas component concentration sensor.

Also preferably, the predetermined operating condition of the engine is a condition in which the engine has continued to be under fuel cut over a second predetermined time period.

Specifically, the second predetermined time period is a time period from the time the fuel cut of the engine is started to the time the temperature of the sensor element of the exhaust gas component concentration sensor lowers below a deterioration detection-enabling sensor element tempeature.

Advantageously, the predetermined time period is a time period within which the temperature of the sensor element of the exhaust gas component concentration sensor can rise to a deterioration detection-enabling sensor element temperature.

To attain the same object, according to a second aspect of the invention, there is provided an air-fuel ratio control system for an internal combustion engine having an exhaust system, comprising:

- an exhaust gas component concentration sensor having a sensor element and arranged in the exhaust system, for detecting concentration of a predetermined component present in exhaust gases emitted from the engine;
- air-fuel ratio control means for controlling an air-fuel ratio of an air-fuel mixture supplied to the engine, based on results of comparison between an output value from the exhaust gas component concentration sensor and a predetermined reference value;
- deterioration-detecting means for detecting deterioration of the exhaust gas component concentration sensor, based on the output value from the exhaust gas component concentration sensor;

engine operating condition-determining means for determining whether or not the engine is in a predetermined operating condition in which a temperature of the sensor element of the exhaust gas component concentration sensor lowers, based on results of detection by the engine operating condition-detecting means;

predetermined time period-setting means for setting a predetermined time period, based on results of determination by the engine operating condition-determining means;

stable operating condition-determining means for determining whether or not the engine has continued to be in a predetermined stable operating condition over the predetermined time period, based on results of detection by the engine operating condition-detecting means; and deterioration detection-permitting means for permitting detection of deterioration of the exhaust gas component concentration sensor by the deterioration-detecting means when it is determined by the stable operating condition-determining means that the engine has continued to be in the predetermined stable operating condition over the predetermined time period.

Also in the second aspect of the invention, preferably, the deterioration-detecting means detects deterioration of the exhaust gas component concentration sensor, based on an inversion period of the output value from the exhaust gas component concentration sensor, and the predetermined operating condition of the engine is a condition in which the engine has continued to be under fuel cut over a second predetermined time period which is a time period from the time the fuel cut of the engine is started to the time the temperature of the sensor element of the exhaust gas component concentration sensor lowers below a deterioration detection-enabling sensor element tempeature.

Advantageously, the predetermined time period-setting means sets the predetermined time period to a time period within which the temperature of the sensor element of the exhaust gas component concentration sensor can rise to a deterioration detection-enabling sensor element temperature, when it is determined by the engine operating condition-determining means that the engine is in the predetermined operating condition.

The above and other objects, features and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
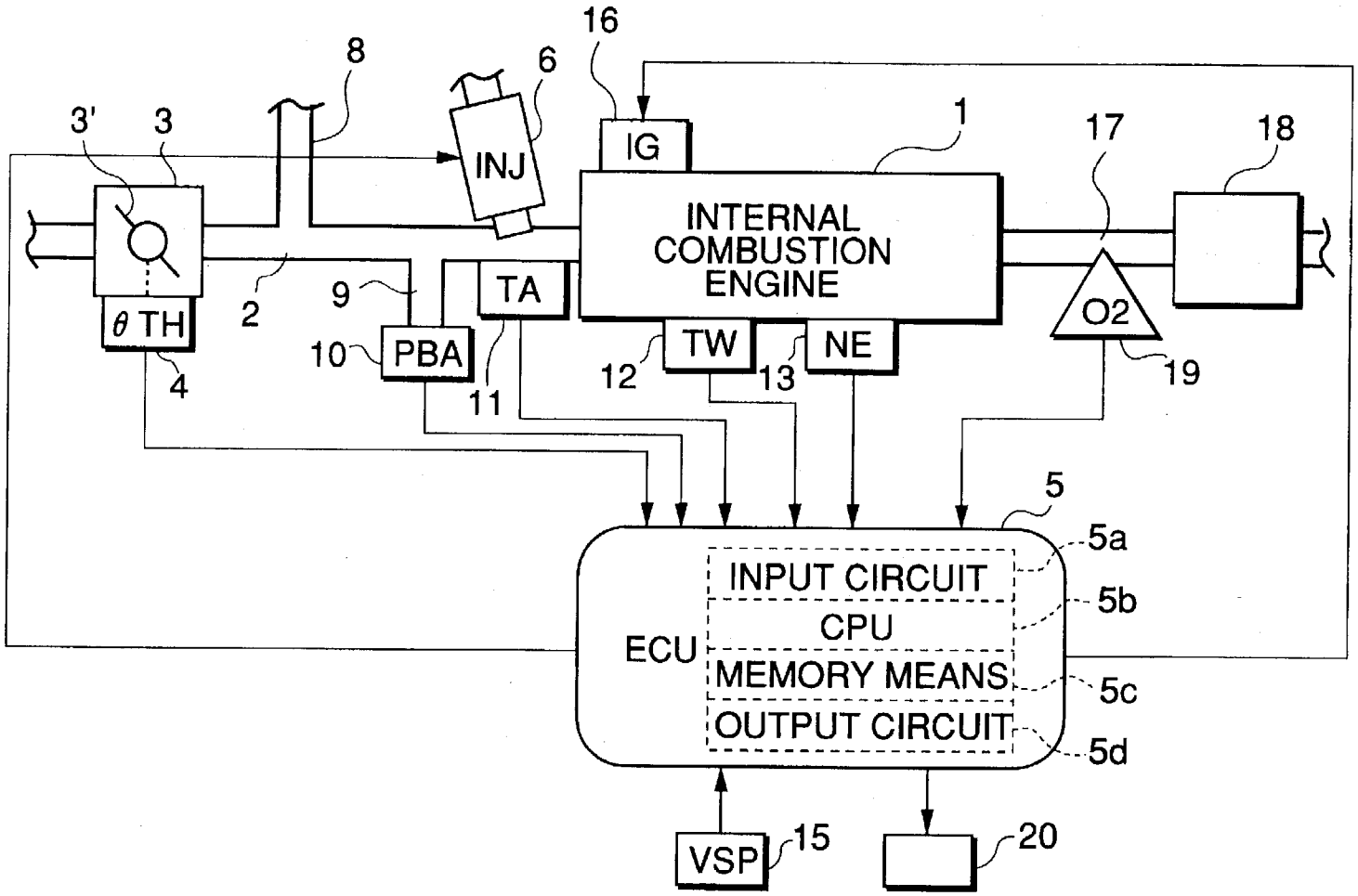
FIG. 1 is a block diagram schematically showing the arrangement of an internal combustion engine and an air-fuel ratio control system therefor, according to an embodiment of the invention.

Referring first to FIG. 1, there is schematically illustrated the whole arrangement of an internal combustion engine and an air-fuel ratio control system therefor, according to an embodiment of the invention.

In the figure, reference numeral 1 designates an internal combustion engine (hereinafter simply referred to as "the engine") having four cylinders. In an intake pipe 2 of the engine 1, there is arranged a throttle body 3 accommodating a throttle valve 3' therein. A throttle valve opening (θTH) sensor 4 is connected to the throttle valve 3', for generating an electric signal indicative of the sensed throttle valve opening θTH and supplying the same to an electronic control unit (hereinafter referred to as "the ECU") 5.

Fuel injection valves (INJ) 6, only one of which is shown, are inserted into the intake pipe 2 at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

A purging passage 8 opens into the intake pipe 2 at a location downstream of the throttle valve 3', which is connected to an evaporative emission control system, not shown.

Further, an intake pipe absolute pressure (PBA) sensor 10 is provided in communication with the interior of the intake pipe 2 via a conduit 9 opening into the intake pipe 2 at a location downstream of the purging passage 8. The PBA sensor 10 is electrically connected to the ECU 5, for supplying an electric signal indicative of the sensed absolute pressure PBA within the intake pipe 2 to the ECU 5.

An intake air temperature (TA) sensor 11 is inserted into the intake pipe 2 at a location downstream of the conduit 9, for supplying an electric signal indicative of the sensed intake air temperature TA to the ECU 5.

An engine coolant temperature (TW) sensor 12, which is formed of a thermistor or the like, is inserted into a coolant passage filled with a coolant and formed in the cylinder block, for supplying an electric signal indicative of the sensed engine coolant temperature TW to the ECU 5.

An engine rotational speed (NE) sensor 13 is arranged in facing relation to a camshaft or a crankshaft of the engine 1, neither of which is shown.

The NE sensor 13 generates a signal pulse (hereinafter referred to as "a TDC signal pulse") at each of predetermined crank angles of the engine 1 whenever the crankshaft rotates through 180 degrees, the TDC signal pulse being supplied to the ECU 5.

Further, a vehicle speed (VSP) sensor 15 is arranged to detect the rotational speed of one of wheels of an automotive vehicle in which the engine 1 is installed, to thereby detect the traveling speed VSP of the automotive vehicle, of which an output signal indicative of the sensed vehicle speed VSP is supplied to the ECU 5.

Each cylinder of the engine 1 has a spark plug (IG) 16 electrically connected to the ECU 5 to have its ignition timing controlled by a signal therefrom.

A catalytic converter (three-way catalyst) 18 is arranged in an exhaust pipe 17 of the engine 1, for purifying noxious components, such as HC, CO, and NOx, which are present in exhaust gases emitted from the engine.

An oxygen concentration sensor (hereinafter referred to as "the O2 sensor") 19 as an exhaust gas component concentration sensor is arranged in the exhaust pipe 17 at a location upstream of the catalytic converter 18, for detecting the concentration of oxygen present in exhaust gases, and generating a signal indicative of the sensed oxygen concentration to the ECU 5. More specifically, the O2 sensor 19 has a sensor element formed of a zirconia solid electrolyte ($ZrO_2$), having a characteristic that an electromotive force thereof drastically changes as the air-fuel ratio of exhaust gases changes across a stoichiometric air-fuel ratio. That is, an output signal from the O2 sensor 19 is inverted from a lean state to a rich state with respect to a predetermined reference value corresponding to the stoichiometric air-fuel ratio or vice versa as the air-fuel ratio changes across the stoichiometric air-fuel ratio, such that the output signal from the O2 sensor 19 goes high in level when the air-fuel ratio of exhaust gases becomes richer than the stoichiometric air-fuel ratio, and goes low in level when the air-fuel ratio of exhaust gases becomes leaner than the stoichiometric air-fuel ratio, respectively. The output signal from the O2 sensor 19 is supplied to the ECU 5.

Further connected to the ECU 5 is an alarm lamp 20 formed of a light emitting diode (LED) or the like, which is arranged, for example, on a dash board within the compartment of the automotive vehicle, to warn the driver of deterioration of the O2 sensor 19 in response to a signal supplied from the ECU 5.

The ECU 5 is comprised of an input circuit **5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* storing various operational programs which are executed by the CPU 5*b* and for storing results of calculations therefrom, etc., an output circuit 5*d* which delivers driving signals to the fuel injection valves 6, the spark plugs 16**, etc.

The CPU **5*b* operates in response to the above-mentioned signals from the sensors to determine operating conditions in which the engine 1 is operating, such as an air-fuel ratio feedback control region in which air-fuel ratio feedback control is carried out in response to oxygen concentration in exhaust gases, and open-loop control regions, and calculates, based upon the determined engine operating conditions, a valve opening period or fuel injection period Tout over which the fuel injection valves 6** are to be opened in synchronism with generation of TDC signal pulses, by the use of the following equation (1):

$$Tout=Ti\times KO2\times K1+K2 \quad (1)$$

where Ti represents a basic value of the fuel injection period Tout, which is determined according to the engine rotational speed NE and the intake pipe absolute pressure PBA by the use of a Ti map, not shown, which is stored in the memory means **5*c***.

KO2 represents an air-fuel ratio correction coefficient which is calculated based on the output signal from the O2 sensor 19 to such a value that the air-fuel ratio (oxygen concentration) detected by the O2 sensor 19 becomes equal to a desired value when the engine 1 is operating in the air-fuel ratio feedback control region, while it is set to predetermined values corresponding to the respective open-loop control regions of the engine 1 when the engine 1 is in the open-loop control regions.

K1 and K2 represent other correction coefficients and correction variables, respectively, which are set according to engine operating parameters to such values as optimize operating characteristics of the engine, such as fuel consumption and engine accelerability.

Next, description will be made of a manner of determining monitoring conditions with reference to FIGS. 2 and 3.

Figure 2:
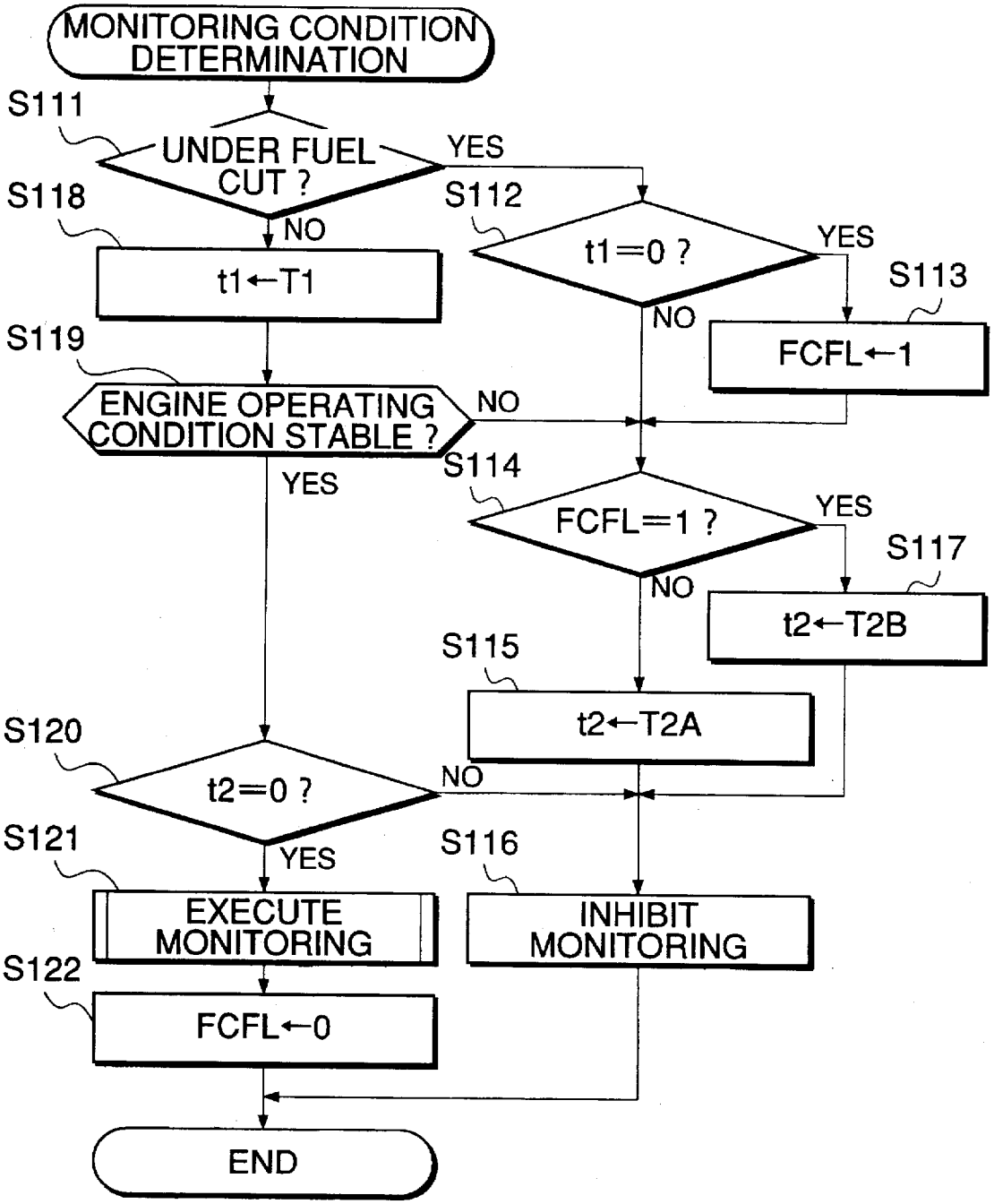
FIG. 2 is a flowchart showing a main routine for determining whether or not monitoring conditions for O2 sensor deterioration are satisfied.

FIG. 2 shows a program for determining whether or not monitoring conditions for O2 sensor deterioration are satisfied. This routine is executed as background processing.

First, at a step S111, it is determined whether or not the engine 1 is under fuel cut. If the answer is affirmative (YES), it is determined at a step S112 whether or not the fuel cut state of the engine 1 has continued over a predetermined time period T1 which is counted by a down-counting timer t1. The predetermined time period T1 is set to the minimum possible time period that can elapse from the time a fuel cut of the engine 1 is started to the time the sensor element temperature of the O2 sensor 19 lowers below a monitoring-enabling element temperature (see FIG. 3).

Figure 3:
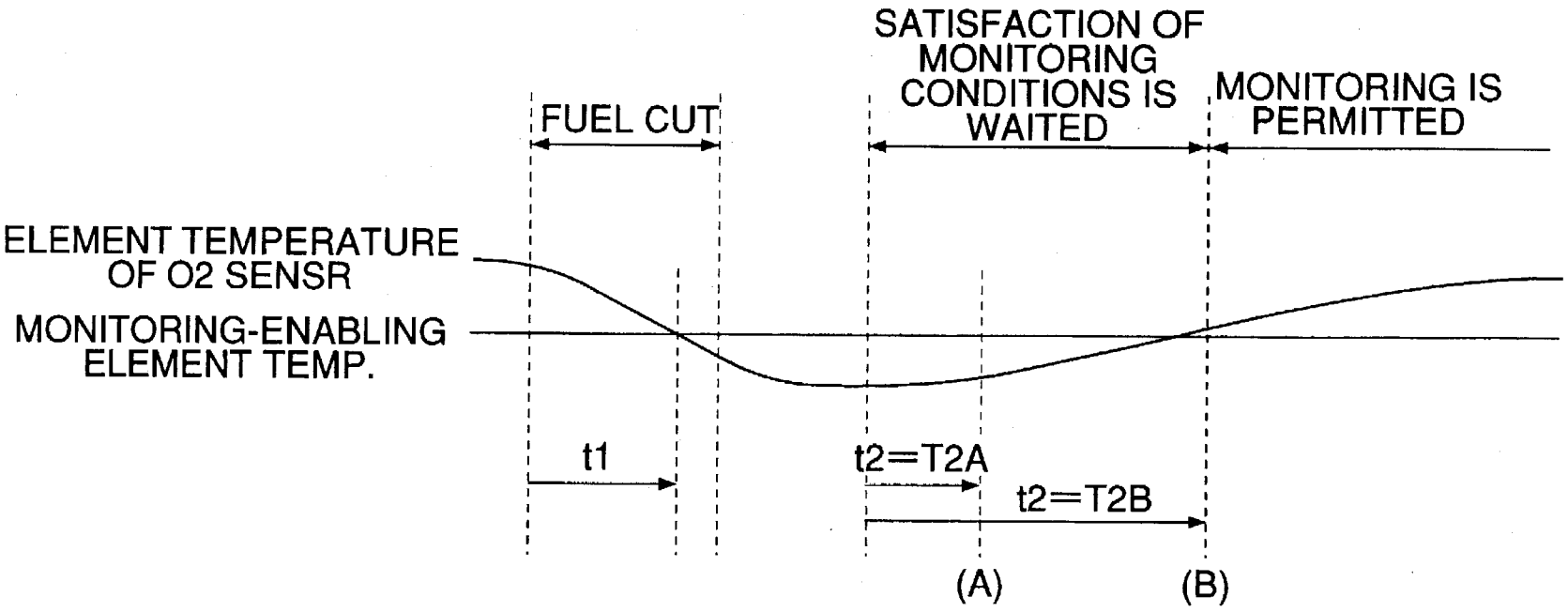
FIG. 3 is a timing chart useful in explaining the monitoring conditions-determining processing of FIG. 2.

FIG. 3 shows a change in the sensor element temperature of the O2 sensor with the lapse of time, which is used to determine satisfaction of the monitoring conditions.

If the answer to the question of the step S112 is affirmative (YES), i.e. if the engine 1 has been under fuel cut over the predetermined time period T1, the program proceeds to a step S113, wherein a fuel cut continuation flag FCFL is set to "1", followed by the program proceeding to a step S114. The fuel cut continuation flag FCFL, when set to "1", indicates that the engine 1 has been under fuel cut over the predetermined time period T1. If the answer to the question of the step S112 is negative (NO), i.e. if the fuel cut state of the engine 1 has not continued over the predetermined time period T1, the program skips over the step S113 to the step S114.

At the step S114, it is determined whether or not the fuel cut continuation flag FCFL is set to "1". If the answer to the question of the step S114 is negative (NO), i.e. if the fuel cut state of the engine 1 has not continued over the predetermined time period T1, it is determined that the sensor element temperature of the O2 sensor 19 exceeds the monitoring-enabling element temperature, and then a monitoring condition satisfaction-waiting timer t2 is set to a predetermined time period T2A suitable for an ordinary state, i.e. a state other than a fuel cut state. The predetermined time period T2A suitable for an ordinary state corresponds to a time period after the lapse of which it can be determined that the engine operating condition has become surely stabilized after shifting into a stable condition under which the O2 sensor monitoring can be carried out. Then, at a step S116, the monitoring is inhibited, followed by terminating the present program.

If the answer to the question of the step S114 is affirmative (YES), i.e. if the engine has been under fuel cut over the predetermined time period T1, it is determined that the sensor element temperature of the O2 sensor 19 has lowered below the monitoring-enabling element temperature, and then the monitoring condition satisfaction-waiting timer t2 is set to a predetermined time period T2B (>T2A) suitable for a fuel cut state at a step S115. The predetermined time period T2B suitable for a fuel cut state is set to the maximum possible time period within which the sensor element temperature of the O2 sensor 19 can rise from the possible minimum value of the O2 sensor element temperature caused by a fuel cut state of the engine 1 over the predetermined time period T1 to the monitoring-enabling element temperature thereof after the engine operating condition shifts into the stable condition following the fuel cut state over the predetermined time period T1. Then the monitoring is inhibited, followed by terminating the present routine.

By virtue of this processing, the monitoring is surely inhibited when the engine 1 is under fuel cut, and when the fuel cut state has continued over the predetermined time period T1, the setting of the monitoring condition satisfaction-waiting timer t2 is changed from the predetermined time period T2A to the predetermined time period T2B.

On the other hand, if the answer to the question of the step S111 is negative (NO), i.e. if the engine 1 is not under fuel cut, the program proceeds to a step S118, wherein the down-counting timer t1 is set to the predetermined time period T1. Then, it is determined at a step S119 whether or not the engine operating condition determined by operating parameters, such as the engine rotational speed NE, the load on the engine, the engine coolant temperature TW, and the intake air temperature TA, is stable. This determination will be described hereinafter. If the answer is affirmative (YES), i.e. if the engine operating condition is stable, it is determined at a step S120 whether or not the time period to which was set the monitoring condition satisfaction-waiting timer t2, i.e. the predetermined time period T2A set at the step S115 or the predetermined time period T2B set at the step S117 has elapsed. If the answer is negative (NO), i.e. if the predetermined time period T2A or T2B has not elapsed, the program proceeds to the step S116, wherein the monitoring of the O2 sensor 19 is inhibited, followed by terminating the present routine. On the other hand, if the answer to the question of the step S120 is affirmative ((YES), i.e. if the predetermined time period T2A or T2B has elapsed, the monitoring of the O2 sensor 19 is carried out to determine whether or not the O2 sensor 19 is deteriorated. This monitoring will be described hereinafter. Then, at a step S122, the fuel cut continuation flag FCFL is set to "0", followed by terminating the present routine.

On the other hand, if it is determined at the step S119 that the operating condition of the engine 1 is not stable, the steps S114, S115 and S116 or alternatively the steps S114, S117 and S116 are sequentially executed to inhibit the monitoring, followed by terminating the present routine.

According to the present embodiment, when a fuel cut state of the engine 1 has continued over the predetermined time period T1, the setting of the monitoring condition satisfaction-waiting timer t2 is changed from the predetermined time period T2A to the predetermined time period T2B (steps S112→S113→S114→S117). In other words, when the engine 1 has been under fuel cut for a long time period and then enters a stable operating state in which the monitoring can be carried out (the answer to the question of the step S119 is affirmative (YES)), the monitoring is inhibited over the predetermined time period T2B which is longer than the predetermined time period T2A (steps S119→S120→S116), and then the monitoring is permitted after the predetermined time period T2B has elapsed (steps S120→S121). As a result, even if the engine has been under fuel cut over the predetermined time period T1 or more, the deterioration determination of the O2 sensor 19 can be carried out with the sensor element temperature of the O2 sensor 19 exceeding the monitoring-enabling element temperature (time point (B) in FIG. 3), leading to prevention of erroneous determination of the O2 sensor deterioration.

If the setting of the monitoring condition satisfaction-waiting timer t2 is not changed from the predetermined time period T2A to the predetermined time period T2B, when the engine has been under fuel cut over the predetermined time period T1, the deterioration determination of the O2 sensor 19 is carried out under a condition in which the sensor element temperature of the O2 sensor 19 is below the monitoring-enabling element temperature (time point (A) in FIG. 3), resulting in incorrect determination of the O2 sensor deterioration.

Figure 4:
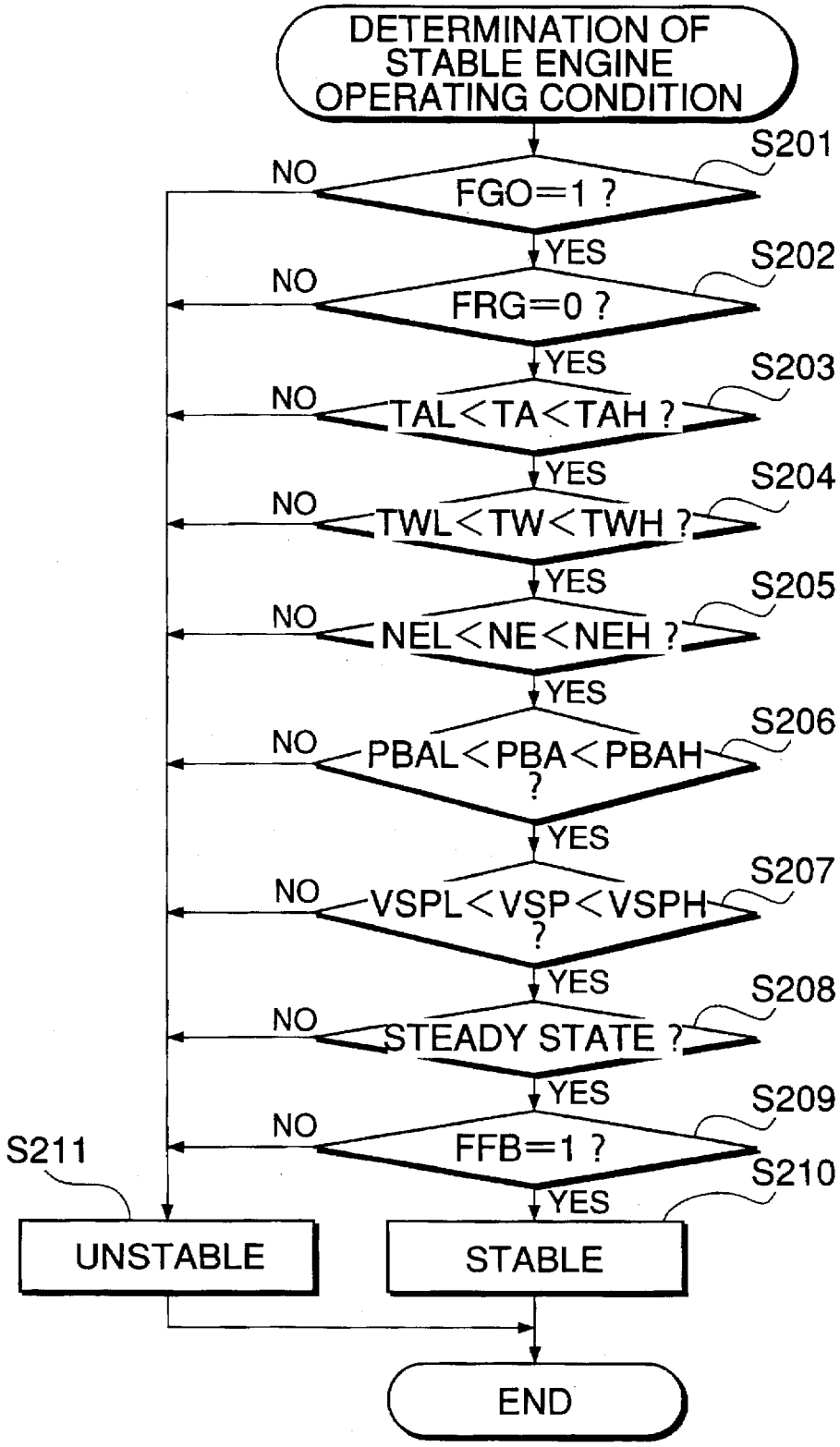
FIG. 4 is a flowchart showing a subroutine for determining whether or not the operating condition of the engine is stable, which is executed at a step S119 in FIG. 2.

FIG. 4 shows a program for determining whether or not the engine operating condition is stable, which is executed at the step S119 in FIG. 2.

First, at a step S201, it is determined whether or not a flag FGO is set to "1". The flag FGO, when set to "1", indicates that the monitoring is permitted, which is set by a routine, not shown. If the answer is affirmative (YES), which means that the monitoring is permitted, it is determined at a step S203 whether or not a flag FPG is set to "0". The flag FPG, when set to "1", indicates that purging from the evaporative emission control system connected to the purging pipe 8 is interrupted, which is set by a routine, not shown. If the flag FPG is set to "1" monitoring of a fuel supply system of the engine is carried out, and therefore the monitoring of the O2 sensor 19 is inhibited. On the other hand, if the flag FPB is set to "0", the program proceeds to a step S203, wherein it is determined whether or not the intake air temperature TA detected by the TA sensor 11 falls between a predetermined lower limit value TAL (e.g. 0° C.) and a predetermined higher limit value TAH (e.g. 100° C.). If the answer is affirmative (YES), it is determined at a step S204 whether or not the engine coolant temperature TW detected by the TW sensor 12 falls between a predetermined lower limit value TWL (e.g. 60° C.) and a predetermined higher limit value TWH (e.g. 100° C.). If the answer is affirmative (YES), it is determined at a step S205 whether or not the engine rotational speed NE detected by the NE sensor 13 falls between a predetermined lower limit value NEL (e.g. 1900 rpm) and a predetermined higher limit value NEH (e.g. 2400 rpm). If the answer is affirmative (YES), it is determined at a step S206 whether or not the intake pipe absolute pressure PBA detected by the PBA sensor 10 falls between a predetermined lower limit value PBAL (e.g. 220 mmHg) and a predetermined higher limit value PBAH (e.g. 530 mmHg). If the answer is affirmative (YES), it is determined at a step S207 whether or not the vehicle speed VSP detected by the VSP sensor 15 falls between a predetermined lower limit value VSPL (e.g. 80 km/hr) and a predetermined higher limit value VSPH (e.g. 100 km/hr). If the answer is affirmative, the program proceeds to a step S208.

At the step S208, it is determined whether or not the vehicle is in a steady traveling condition. The steady traveling condition of the vehicle is determined from whether or not a variation in the vehicle speed has continuously been within a range of ±0.8 km/hr per second over two seconds. If the answer is affirmative, it is determined at a step S209 whether or not a flag FFB is set to "1". The flag FFB, when set to "1", indicates that air-fuel ratio feedback control based on the output from the O2 sensor 19 is being carried out. If the answer is affirmative (YES), the program proceeds to a step S210, wherein it is temporarily determined that the engine operating condition is stable.

On the other hand, if any of the answers to the questions of the steps S201 to S209 is negative (NO), the program proceeds to a step S211, wherein it is temporarily determined that the engine operating condition is unstable, followed by terminating the present program.

Figure 5:
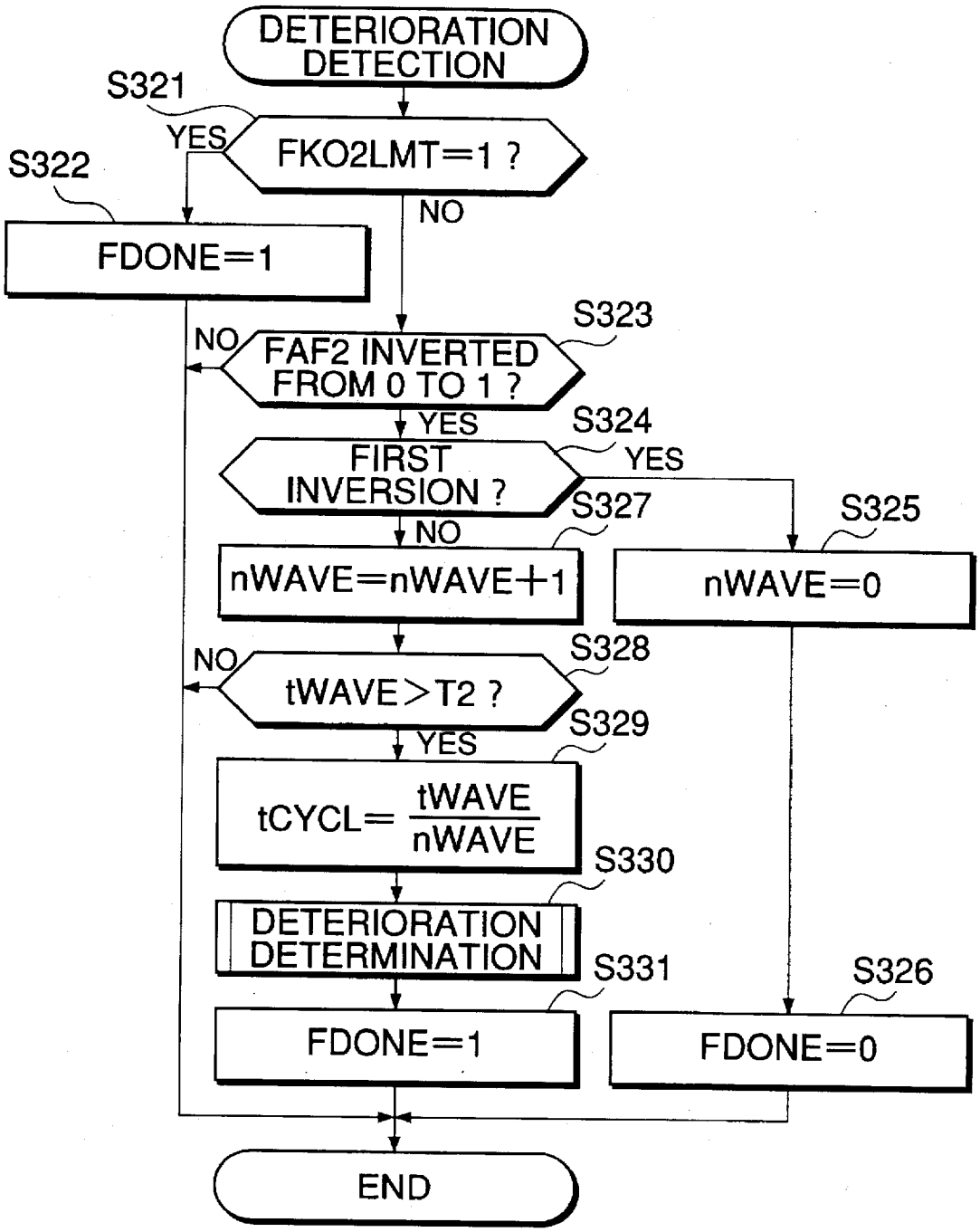
FIG. 5 is a flowchart showing a subroutine for monitoring (detecting) deterioration of the O2 sensor, which is executed at a step S121 in FIG. 2.

FIG. 5 shows a routine for monitoring or detecting deterioration of the O2 sensor 19, which is executed at the step S121 in FIG. 2. This routine is executed at regular time intervals, e.g. every 100 msec.

First, it is determined at a step S321 whether or not a flag FKO2LMT which is set by a routine, not shown, is set to "1", which means that the air-fuel ratio correction coefficient KO2 is held at a predetermined upper limit value or a predetermined lower limit value, i.e. the KO2 value has continuously been set at the predetermined upper limit value or the predetermined lower limit value. If the answer is affirmative (YES), i.e. if the KO2 value is held at the predetermined upper or lower limit value, the program proceeds to a step S322, wherein a flag FDONE is set to "1", followed by terminating the program. The flag FDONE is set to "0" when a command to start detection of the O2 sensor 19 deterioration is issued by the CPU 5, and set to "1" when the detection of the O2 sensor 19 deterioration has been completed. Therefore, when the air-fuel ratio correction coefficient KO2 is held at the predetermined upper or lower limit value, the flag FDONE is set to "1", which means that the detection of the O2 sensor 19 deterioration has been already executed, and then the program is immediately terminated.

On the other hand, if the flag FKO2LMT is not set to "1", it is determined at a step S323 whether or not a flag FAF2 has been inverted from "0" set in the last loop of execution of the routine to "1" set in the present loop thereof. The flag FAF2 is set to "0" when the air-fuel ratio of a mixture supplied to the engine is lean, and set to "1" when a predetermined time period has elapsed since an inversion of the air-fuel ratio of the mixture from a lean value to a rich value. If the answer is negative (NO), the program is immediately terminated. On the other hand, if the answer is affirmative (YES), i.e. if the air-fuel ratio of the mixture has been inverted from a lean value to a rich value in the present loop, the program proceeds to a step S324, wherein it is determined whether or not the flag FAF2 has been inverted for the first time after the monitoring of detection of the O2 sensor 19 deterioration was permitted. In the first loop of execution of the routine, the answer is affirmative (YES), and then the program proceeds to a step S325, wherein the number nWAVE of times of inversion in the O2 sensor output is set to "0". Then, at a step S326 the flag FDONE is set to "0" to indicate that the detection of the O2 sensor 19 deterioration should be started, followed by terminating the routine.

On the other hand, if the answer to the question of the step S324 becomes negative (NO) in the next or a subsequent loop, the program proceeds to a step S327, wherein the number nWAVE of times of inversion is incremented by "1", and then it is determined at a step S328 whether or not a measuring time period tWAVE required for counting the number nWAVE of times of inversion exceeds a predetermined time period T3 (e.g. 10 sec). If the answer is negative (NO), the program is immediately terminated, whereas if the answer is affirmative (YES), the program proceeds to a step S329, wherein an inversion period tCYCL of the output from the O2 sensor 19 is calculated by the use of the following equation (2):

$$tCYCL = tWAVE/nWAVE \quad (2)$$

After the inversion period tCYCL has been calculated as above, determination of deterioration of the O2 sensor is carried out at a step S330, and the flag FDONE is set to "1" to indicate that the detection of the O2 sensor 19 deterioration has been completed at a step S331, followed by terminating the routine.

Figure 6:
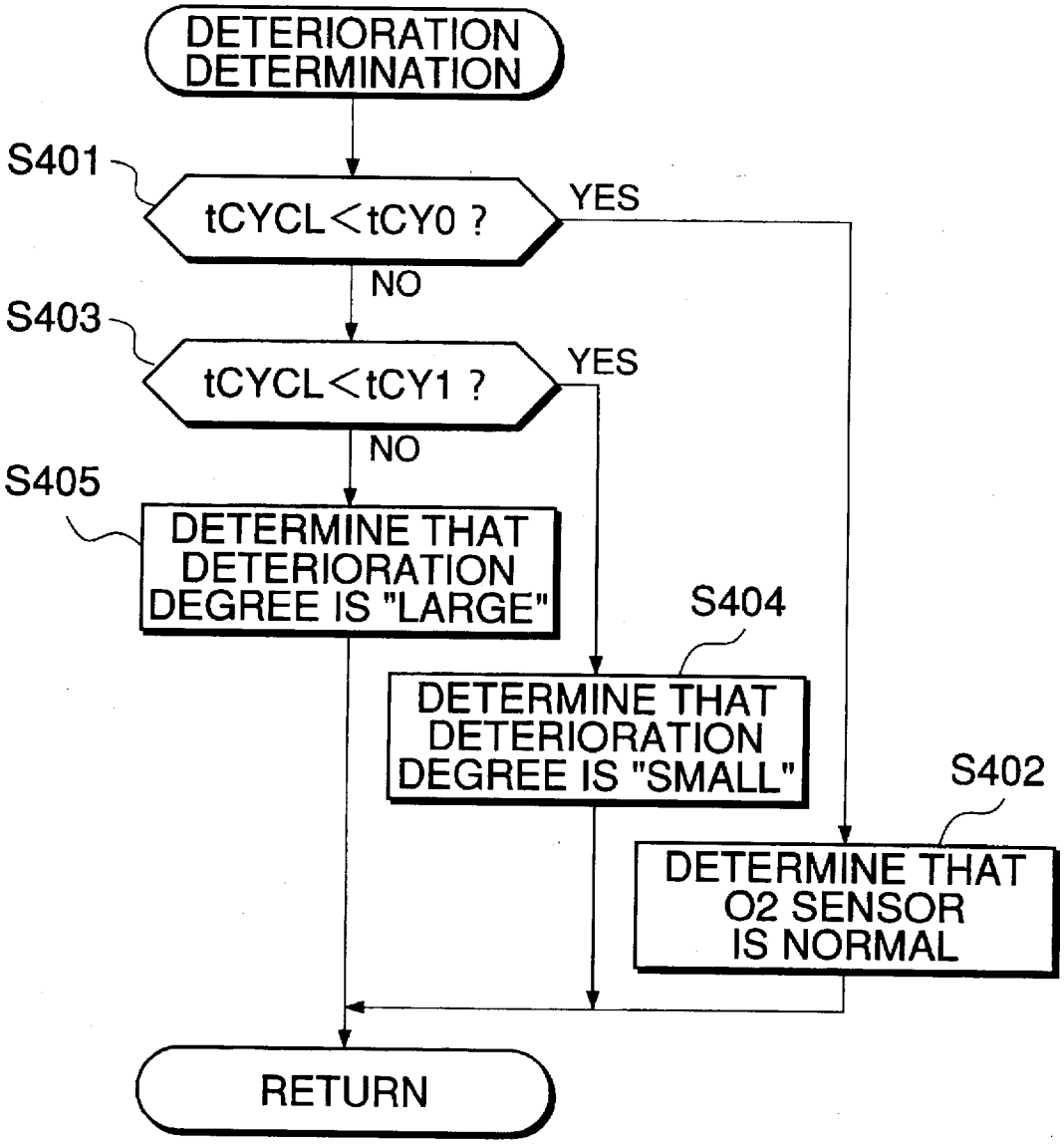
FIG. 6 is a flowchart showing a subroutine for determining deterioration of the O2 sensor, which is executed at a step S330 in FIG. 5.

The determination of the O2 sensor deterioration at the step S330 is carried out by executing a deterioration-determining subroutine shown in FIG. 6.

First, it is determined at a step S401 in FIG. 6 whether or not the inversion period tCYCL calculated at the step S329 in FIG. 5 is shorter than a first predetermined inversion period tCY0. The first predetermined inversion period tCY0 is set to a value short enough to determine that the O2 sensor 19 is not deteriorated, e.g. 2 sec. If the answer is affirmative (YES), it is determined at a step S402 that the O2 sensor 19 is in a normal state (functioning normally), followed by the program returning to the main routine of FIG. 5. On the other hand, if the answer to the question of the step S401 is negative (NO), it is determined at a step S403 whether or not the inversion period tCYCL is shorter than a second predetermined inversion period tCY1. The second predetermined inversion period tCY1 is set to a value longer than the first predetermined inversion period tCY0, i.e. such that a relationship of tCY0<tCY1 holds. If the answer is affirmative (YES), i.e. if tCYCL<tCY1 holds, it is determined at a step S404 that the O2 sensor 19 is deteriorated but the deterioration degree thereof is so small that the air-fuel ratio feedback control based on the sensor output need not be inhibited, followed by the program returning to the main routine of FIG. 5. On the other hand, if the answer at the step S403 is negative (NO), it is determined at a step S405 that the O2 sensor 19 is deteriorated to such a large degree as to cause degradation of exhaust emission characteristics and drivability of the engine if the air-fuel ratio feedback control based on the senor output is carried out, i.e. the deterioration degree of the O2 sensor 19 is "large", followed by the program returning to the main routine of FIG. 5.

Thereafter, a processing for carrying out a fail-safe action is executed depending upon the result of the above deterioration determination. If the O2 sensor 19 is determined to be deteriorated, the alarm lamp 20 is lit on to warn the driver of the deterioration of the O2 sensor 19, and the air-fuel ratio control is carried out in a suitable manner depending on the deterioration degree of the O2 sensor 19.

What is claimed is:

1. An air-fuel ratio control system for an internal combustion engine having an exhaust system, comprising:

an exhaust gas component concentration sensor having a sensor element and arranged in said exhaust system, for detecting concentration of a predetermined component present in exhaust gases emitted from said engine;

air-fuel ratio control means for controlling an air-fuel ratio of an air-fuel mixture supplied to said engine, based on results of comparison between an output value from said exhaust gas component concentration sensor and a predetermined reference value;

deterioration-detecting means for detecting deterioration of said exhaust gas component concentration sensor, based on said output value from said exhaust gas component concentration sensor;

engine operating condition-detecting means for detecting operating conditions of said engine;

engine operating condition-determining means for determining whether or not said engine is in a predetermined operating condition in which a temperature of said sensor element of said exhaust gas component concentration sensor lowers, based on results of detection by said engine operating condition-detecting means; and deterioration detection-inhibiting means for inhibiting detection of deterioration of said exhaust gas component concentration sensor by said deterioration-detecting means over a predetermined time period after said engine leaves said predetermined operating condition.

2. An air-fuel ratio control system as claimed in claim 1, wherein said deterioration-detecting means detects deterioration of said exhaust gas component concentration sensor, based on an inversion period of said output value from said exhaust gas component concentration sensor.

3. An air-fuel ratio control system as claimed in claim 1, wherein said predetermined operating condition of said engine is a condition in which said engine has continued to be under fuel cut over a second predetermined time period.

4. An air-fuel ratio control system as claimed in claim 3, wherein said second predetermined time period is a time period from the time said fuel cut of said engine is started to the time said temperature of said sensor element of said exhaust gas component concentration sensor lowers below a deterioration detection-enabling sensor element tempeature.

5. An air-fuel ratio control system as claimed in claim 1, wherein said predetermined time period is a time period within which said temperature of said sensor element of said exhaust gas component concentration sensor can rise to a deterioration detection-enabling sensor element temperature.

6. An air-fuel ratio control system for an internal combustion engine having an exhaust system, comprising:

an exhaust gas component concentration sensor having a sensor element and arranged in said exhaust system, for detecting concentration of a predetermined component present in exhaust gases emitted from said engine;

air-fuel ratio control means for controlling an air-fuel ratio of an air-fuel mixture supplied to said engine, based on results of comparison between an output value from said exhaust gas component concentration sensor and a predetermined reference value;

deterioration-detecting means for detecting deterioration of said exhaust gas component concentration sensor, based on said output value from said exhaust gas component concentration sensor;

engine operating condition-determining means for determining whether or not said engine is in a predetermined operating condition in which a temperature of said sensor element of said exhaust gas component concentration sensor lowers, based on results of detection by said engine operating condition-detecting means;

predetermined time period-setting means for setting a predetermined time period, based on results of determination by said engine operating condition-determining means;

stable operating condition-determining means for determining whether or not said engine has continued to be in a predetermined stable operating condition over said predetermined time period, based on results of detection by said engine operating condition-detecting means; and deterioration detection-permitting means for permitting detection of deterioration of said exhaust gas component concentration sensor by said deterioration-detecting means when it is determined by said stable operating condition-determining means that said engine has continued to be in said predetermined stable operating condition over said predetermined time period.

7. An air-fuel ratio control system as claimed in claim 6, wherein said deterioration-detecting means detects deterioration of said exhaust gas component concentration sensor, based on an inversion period of said output value from said exhaust gas component concentration sensor.

8. An air-fuel ratio control system as claimed in claim 6, wherein said predetermined operating condition of said engine is a condition in which said engine has continued to be under fuel cut over a second predetermined time period.

9. An air-fuel ratio control system as claimed in claim 8, wherein said second predetermined time period is a time period from the time said fuel cut of said engine is started to the time said temperature of said sensor element of said exhaust gas component concentration sensor lowers below a deterioration detection-enabling sensor element tempeature.

10. An air-fuel ratio control system as claimed in claim 6, wherein said predetermined time period-setting means sets said predetermined time period to a time period within which said temperature of said sensor element of said exhaust gas component concentration sensor can rise to a deterioration detection-enabling sensor element temperature, when it is determined by said engine operating condition-determining means that said engine is in said predetermined operating condition.

* * * * *